US010960701B2

(12) United States Patent
Ida et al.

(10) Patent No.: US 10,960,701 B2
(45) Date of Patent: Mar. 30, 2021

(54) SADDLE-STITCH BOOKBINDING SYSTEM

(71) Applicant: Horizon International Inc., Takashima (JP)

(72) Inventors: Tatsuaki Ida, Takashima (JP); Takakazu Hori, Takashima (JP); Masayuki Kashiba, Takashima (JP)

(73) Assignee: HORIZON INTERNATIONAL INC., Shiga (JP)

( * ) Notice: Subject to any disclaimer, the term of this patent is extended or adjusted under 35 U.S.C. 154(b) by 0 days.

(21) Appl. No.: 16/474,229

(22) PCT Filed: May 12, 2017

(86) PCT No.: PCT/JP2017/017987
§ 371 (c)(1),
(2) Date: Jun. 27, 2019

(87) PCT Pub. No.: WO2018/207335
PCT Pub. Date: Nov. 15, 2018

(65) Prior Publication Data

US 2019/0351692 A1 Nov. 21, 2019

(51) Int. Cl.
*B42B 4/00* (2006.01)
*B42C 19/02* (2006.01)

(52) U.S. Cl.
CPC ..... *B42B 4/00* (2013.01); *B42C 19/02* (2013.01)

(58) Field of Classification Search
CPC ..... B42B 4/00; B42C 19/02; B41L 43/00; B65H 2301/43826; B65H 2301/436;
(Continued)

(56) References Cited

U.S. PATENT DOCUMENTS 5,106,066 A * 4/1992 Shea ..... B27F 7/28 227/131
5,938,100 A * 8/1999 Bloser ..... B27F 7/21 227/107

(Continued)

FOREIGN PATENT DOCUMENTS

JP 2014-151638 A 8/2014

OTHER PUBLICATIONS

International Search Report dated Jul. 11, 2017, issued in counterpart application No. PCT/JP2017/017987 (2 pages).

*Primary Examiner* — Leslie A Nicholson, III
(74) *Attorney, Agent, or Firm* — Westerman, Hattori, Daniels & Adrian, LLP

(57) ABSTRACT

A folding machine folding a sheet P1 into a predetermined folding pattern to form a signature P3, a saddle stitching machine 3 arranged downstream of the folding machine to staple and fold the signature and a control unit 15 controlling the folding machine and saddle stitching machine are provided. The folding machine has parameters adjustable depending on a thickness of the sheet. The saddle stitching machine has parameters adjustable depending on a thickness of the signature P3, P4. The control unit sets the parameters of the folding machine based on the information about the thickness of the sheet and sets the parameters of the saddle stitching machine based on the information about the thickness of the signature calculated using the information about the thickness of the sheet and the information about the folding pattern of the folding machine.

7 Claims, 4 Drawing Sheets

(58) Field of Classification Search
CPC .. B65H 2301/44312; B65H 2301/4479; B65H 2301/4505
USPC ..... 270/37, 52.18, 52.26, 52.29
See application file for complete search history.

(56) References Cited

U.S. PATENT DOCUMENTS 6,095,740 A * 8/2000 Hohenstein ..... B42B 9/04 270/52.26
6,994,337 B1 * 2/2006 Cracknell ..... B26D 1/08 270/52.26
7,032,898 B2 * 4/2006 Silberbauer ..... B27F 7/21 270/52.18
7,261,507 B2 * 8/2007 Horii ..... B42B 4/00 412/33
7,281,706 B2 * 10/2007 Kinne ..... B42B 4/00 198/644
7,503,556 B2 * 3/2009 Sugimoto ..... B65H 45/18 270/32
7,660,556 B2 * 2/2010 Saitsu ..... B42C 1/12 270/20.1
7,984,897 B2 * 7/2011 Williams ..... B42B 4/00 227/100
8,109,497 B2 * 2/2012 Okamoto ..... B65H 37/04 270/20.1
8,118,295 B2 * 2/2012 Marcinik ..... B42B 4/00 270/52.18

* cited by examiner

SADDLE-STITCH BOOKBINDING SYSTEM

TECHNICAL FIELD

The present invention relates to a saddle-stitch bookbinding system.

BACKGROUND ART

An example of conventional saddle-stitch bookbinding systems is disclosed in Patent Document 1.

The saddle-stitch bookbinding system disclosed in Patent Document 1 comprises a sheet supplying machine supplying sheets one by one from a stack of sheets, a folding machine folding the sheet supplied from the sheet supplying machine to form a signature, and a saddle stitching machine connected to an exit of the folding machine through a connection unit so as to staple and fold the signature.

The saddle stitching machine has a folding unit folding the signature supplied from the folding machine in two along a predetermined folding line.

The saddle stitching machine also has a stitching unit arranged downstream of the folding unit. The stitching unit is provided with a conveying mechanism conveying the two-folded signature in a saddle manner, and a stitcher arranged at a stitching position on a conveying path of the conveying mechanism to staple the two-folded signature at one or more predetermined positions on the folding line.

Thus the sheets are supplied one by one from the sheet supplying machine and folded by the folding machine to form a signature, thereafter the signature is folded in two, conveyed to the stitching position in a saddle manner and stapled by the saddle stitching machine. Next the stapled and two-folded signature is conveyed to a three side trimmer so as to be finished into a booklet.

In this saddle-stitch bookbinding system, the folding machine has one or more parameters adjustable depending on a thickness of the sheet and the saddle stitching machine has one or more parameters adjustable depending on a thickness of the signature.

Therefore, before the start of bookbinding, it is necessary to perform initial setting of the respective parameters of the folding machine and the saddle stitching machine according to the type of booklet to be bound.

However, in conventional saddle-stitch bookbinding systems, the initial setting of the respective parameters of the folding machine and the initial setting of the respective parameters of the saddle stitching machine are performed independently of each other, so that it takes time and effort to complete the initial setting of the parameters of the saddle-stitch bookbinding systems.

PRIOR ART DOCUMENTS

Patent Documents

Patent Document 1: JP 2014-151638 A

SUMMARY OF THE INVENTION

Problems to be Solved by the Invention

It is, therefore, an object of the present invention to provide a saddle-stitch bookbinding system whose initial setting of the parameters can be done easily and quickly.

Means for Solving the Problems

In order to resolve the object, the present invention provides a saddle-stitch bookbinding system comprising: a folding machine folding a sheet into a predetermined folding pattern to forma signature; a saddle stitching machine arranged downstream of the folding machine to staple and fold the signature; and a control unit operatively connected to the folding machine and the saddle stitching machine, wherein the folding machine has one or more parameters adjustable depending on a thickness of the sheet and the saddle stitching machine has one or more parameters adjustable depending on a thickness of the signature, wherein the one or more parameters of the folding machine are set by the control unit based on the information about the thickness of the sheet, and the one or more parameters of the saddle stitching machine are set by the control unit based on the information about the thickness of the signature calculated by the control unit using the information about the thickness of the sheet and the information about the folding pattern of the folding machine.

According to a preferred embodiment of the present invention, the saddle stitching machine has: a folding unit taking in the signature from an entrance of the saddle stitching machine and folding the signature in two along a predetermined folding line; a stitching unit arranged downstream of the folding unit to staple the two-folded signature at one or more predetermined positions on the folding line; and a discharging unit arranged downstream of the stitching unit to convey the stapled and two-folded signature to an exit of the saddle stitching machine, wherein the stitching unit has: a conveying mechanism conveying the two-folded signature in a saddle manner; a stitcher arranged at a stitching position on a signature conveying path of the conveying mechanism to staple the two-folded signature at the one or more predetermined positions on the folding line; and a sensor arranged at the stitching position to detect the presence of a wire to be driven from the stitcher to the signature, wherein the discharging unit has: at least one press roller pair extending across a conveying path extended from the stitching unit to the exit of the saddle stitching machine; and/or at least one pair of conveyor belt pairs arranged parallel with the conveying path and spaced from each other in a width direction of the conveying path, the stapled and two-folded signature being conveyed between the at least one press roller pair and/or the respective conveyor belt pairs, wherein the one or more parameters of the saddle stitching machine are at least one of a length of the wire supplied to the stitcher at every stapling operation and a height of the sensor and a gap between the at least one press roller pair and a gap between the respective conveyor belt pairs.

Effects of the Invention

According to the present invention, the one or more parameters of the folding machine are set based on the information about the thickness of the sheet and the one or more parameters are set based on the information about the thickness of the signature calculated from the information about the thickness of the sheet and the information about the folding pattern of the folding machine, and thereby the setting of the parameters of the saddle-stitch bookbinding system can be done easily and quickly.

BEST MODE FOR CARRYING OUT THE INVENTION

A preferred embodiment of the present invention will be explained below with reference to the accompanying drawings.

Figure 1:
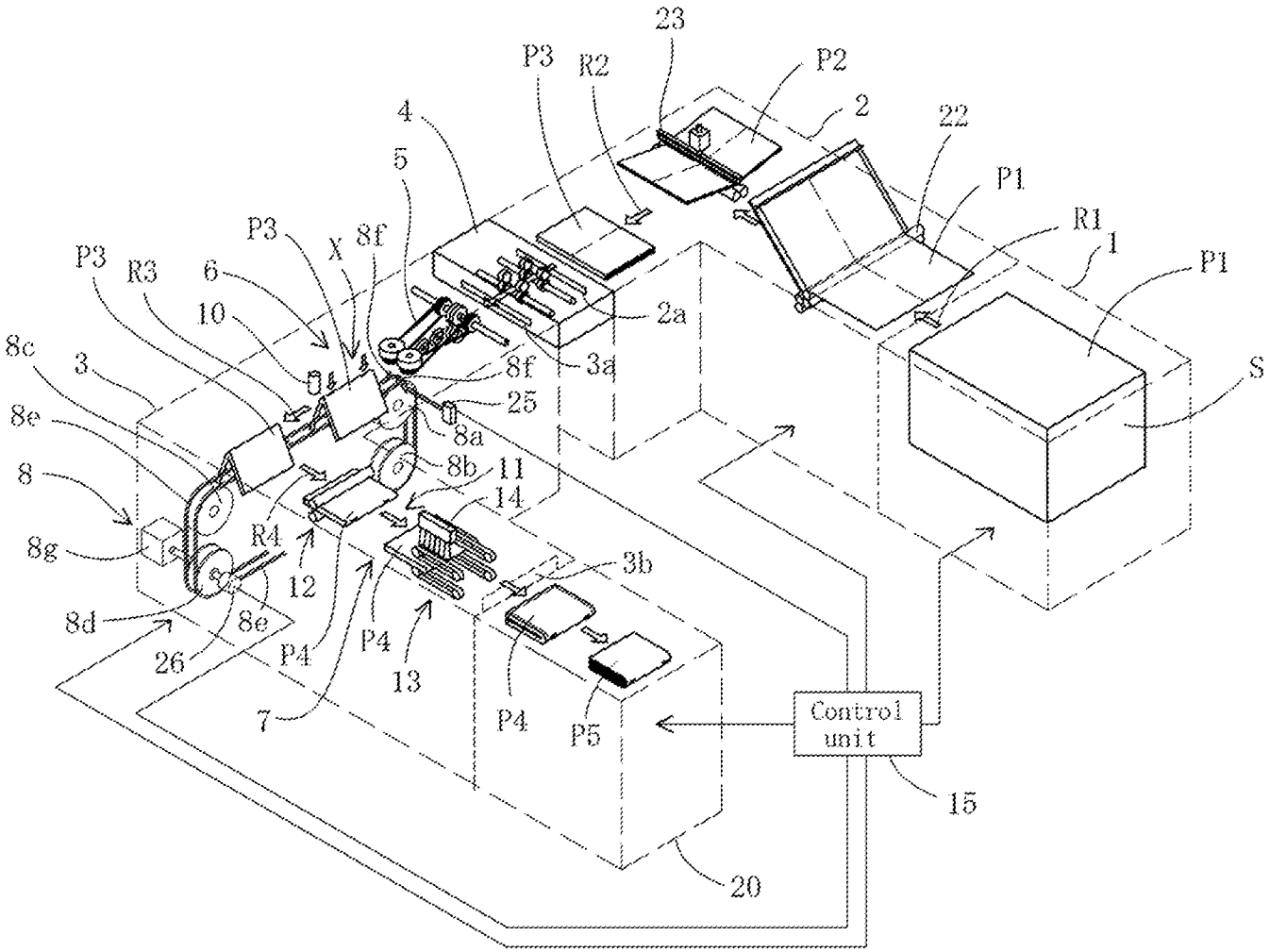
FIG. 1 is a schematic perspective view of a saddle-stitch bookbinding system according to an embodiment of the present invention.

FIG. 1 is a schematic perspective view of a saddle-stitch bookbinding system according to an embodiment of the present invention.

As shown in FIG. 1, the saddle-stitch bookbinding system of the present invention comprises a sheet supplying machine 1 supplying sheets P1 one by one from a stack of sheets S, a folding machine 2 folding the sheet P1 supplied from the sheet supplying machine 1 to form a signature P3, a saddle stitching machine 3 stapling and folding the signature P3, and a connection unit 4 arranged between an exit 2*a* of the folding machine 2 and an entrance 3*a* of the saddle stitching machine 3 to convey the signature P3 from the folding machine 2 to the saddle stitching machine 3.

The folding machine 2 has a buckle-type folding unit 22 and a knife-type folding unit 23 which is arranged downstream of the buckle-type folding unit 22.

Figure 2A:
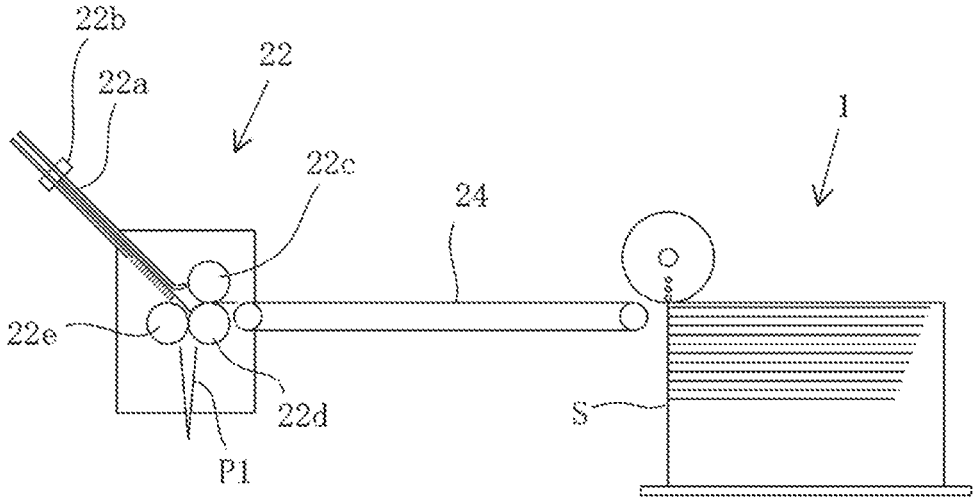
FIG. 2A is a schematic front view of a buckle-type folding unit and a sheet conveying unit of the folding machine of the saddle-stitch bookbinding system shown in FIG. 1 and a sheet supplying machine of the saddle-stitch bookbinding system.

The buckle-type folding unit 22, as shown in FIG. 2A, has a single buckle 22*a* into which the sheet P1 is inserted by a length corresponding to a predetermined position for folding. The buckle 22*a* is provided with a stopper 22*b* whose position is adjustable. The sheet P1 collides with the stopper 22*b* at a leading end thereof so as to be positioned by the stopper 22*b* at the predetermined position for folding.

A pair of rollers 22*c*, 22*d* is arranged opposite to each other at an entrance of the buckle 22*a* so as to take in the sheet P1 to the buckle 22*a*, and a pair of rollers 22*d*, 22*e* is arranged opposite to each other at the entrance of the buckle 22*a* so as to fold a portion of the sheet P1 deflected from the buckle 22*a*.

As is clear from FIG. 2A, a sheet conveying unit 24 is arranged between the sheet supplying machine 1 and the buckle-type folding unit 22, and the sheet P1 supplied from the sheet supplying machine 1 is conveyed by the sheet conveying unit 24 to a gap between the roller pair 22*c*, 22*d* of the buckle-type folding unit 22.

The buckle-type folding unit 22 folds in two the sheet P1 supplied from the sheet supplying machine 1 along a direction perpendicular to the sheet supplying direction (indicated by an arrow R1) (see, a sheet P2).

A gap between each pair of rollers 22*c*, 22*d*; 22*d*, 22*e* of the buckle-type folding unit 22 is adjusted depending on a thickness of the sheet P1.

Figure 2B:
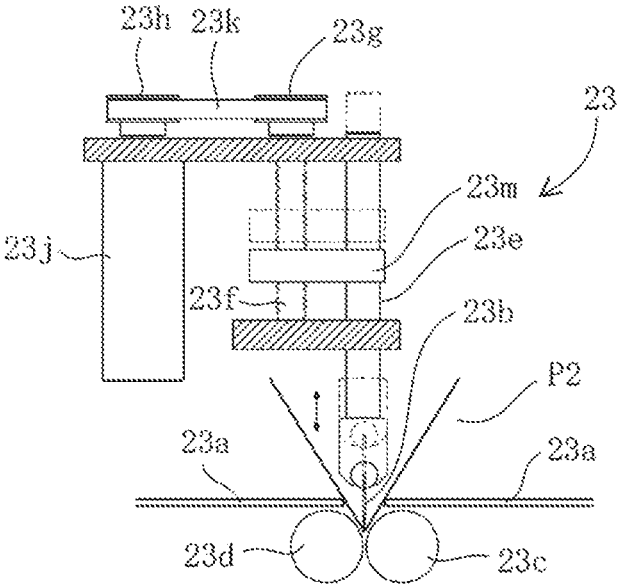
FIG. 2B is a schematic perspective view of a knife-type folding unit of the folding machine of the saddle-stitch bookbinding system shown in FIG. 1.

The knife-type folding unit 23, as shown in FIG. 2B, has a table 23*a* on which the sheet P2 is placed, a positioning means (not shown) positioning the sheet P2 at a predetermined folding position on the table 23*a*, a knife blade 23*b* and a pair of folding rollers 23*c*, 23*d* arranged opposite to each other with the table 23*a* therebetween at the folding position, and a knife elevation mechanism moving the knife blade 23*b* in a vertical direction through a slit between a first position above the table 23*a* and a second position close to a gap between the folding rollers 23*c*, 23*d*.

The knife elevation mechanism comprises a slide guide 23*e* arranged above the table 23*a* and aligned with the slit of the table 23*a* so as to be slidable in a vertical direction, and the knife blade 23*b* is attached to a lower end of the slide guide 23*e*. The knife elevation mechanism also comprises a ball screw 23*f* arranged parallel with the slide guide 23*e* and capable of rotating about an axis thereof in place and a pulley 23*g* attached coaxially to an upper end of the ball screw 23*f*.

The slide guide 23*e* is connected to a nut 23*m* of the ball screw 23*f* at a middle portion thereof.

The knife elevation mechanism further comprises a motor 23*j*, a pulley 23*h* mounted on a vertical drive shaft of the motor 23*j*, and a timing belt 23*k* extending between the pulley 23*h* and the pulley 23*g*.

Thus the ball screw 23*f* is rotated forward and reverse by the motor 23*j* and the resulting vertical movement of the slide guide 23*e* raises and lowers the knife blade 23*b*.

The knife-type folding unit 23 folds the sheet P2 in two along a direction perpendicular to the previous folding direction (the folding direction of the buckle-type folding unit 22) to form the signature P3, and discharges the signature P3 from the exit 2*a* of the folding machine 2 in a direction (indicated by an arrow R2) perpendicular to the sheet supplying direction of the sheet supplying machine 1.

The gap between the folding rollers 23*c*, 23*d* of the knife-type folding unit 23 is adjusted depending on the thickness of the sheet P2.

Although the folding machine 2 forms a signature by folding a sheet twice in this embodiment, a configuration of the folding machine 2 is not limited to this embodiment, and it is possible to arrange any type of folding machine which forms a signature by folding a sheet certain number of times (for example three or four times etc.).

The saddle stitching machine 3 has a folding unit 5 taking in the signature P3 from the entrance 3*a* of the saddle stitching machine 3 and folding the signature P3 into a mountain fold (folding the signature P3 in two) along a predetermined folding line, a stitching unit 6 arranged downstream of the folding unit 5 to staple the mountain-folded signature P3 at one or more predetermined positions on the folding line, and a discharging unit 7 arranged downstream of the stitching unit 6 to convey the stapled and two-folded signature P4 to the exit 3*b* of the saddle stitching machine 3.

The stitching unit 6 also has a conveying mechanism 8 conveying the mountain-folded signature P3 in a saddle manner, a stopper (not shown) positioning the signature P3 at a stitching position X on a signature conveying path of the conveying unit 8, a stitcher 9 arranged at the stitching position X to staple the two-folded signature P3 at one or more predetermined positions on the folding line of the signature P3, and a sensor 10 arranged downstream of the stitching position X to detect the presence of a wire to be driven from the stitcher 9 to the signature P3.

The conveying mechanism 8, as shown in FIG. 1, includes pairs of pulleys 8*a*, 8*b*; 8*c*, 8*d* spaced from each other in the signature conveying direction (indicated by an arrow R3) each of which is supported so as to be rotatable about a horizontal axis perpendicular to the signature conveying direction (the arrow R3). Each pair of pulleys 8*a*, 8*b*; 8*c*, 8*d* is composed of an upper pulley 8*a*, 8*c* and a lower pulley 8*b*, 8*d* which are vertically spaced from each other.

Endless belts 8*e* are extended between the pulleys 8*a*-8*d*, and a drive shaft of a motor 8*g* is coupled to an axis of one of the pulleys 8*a*-8*d* (in this embodiment, the pulley 8*d*). Further, feed claws 8*f* are fixed on the endless belts 8*e* at regular intervals.

Thus the endless belts 8*e* are circulated by the motor 8*g* through the pulleys 8*a*-8*d* in a vertical plane, and each time the signature P3 is supplied from the folding unit 5 onto the endless belts 8*e*, the feed claw 6*f* collides with a tail end of the signature P3, whereby the signature P3 is conveyed along an upper linear portion (a portion between the upper pulleys 8*a* and 8*c*) of the endless belts 8*e* in a saddle manner.

Figure 3A:
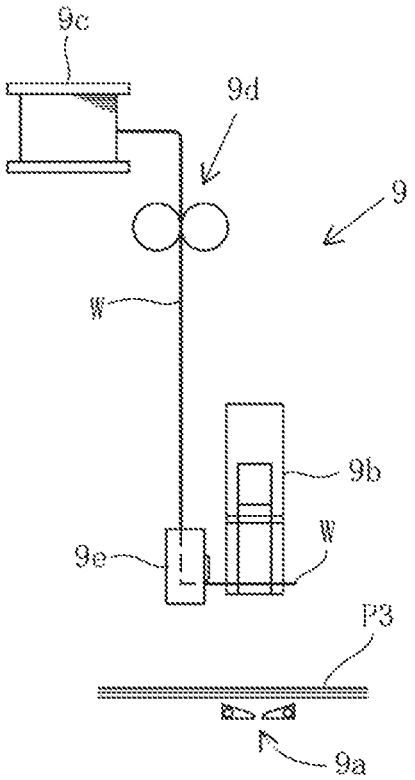
FIG. 3A is a schematic front view of a stitcher of a saddle stitching machine of the saddle-stitch bookbinding system shown in FIG. 1.

FIG. 3A is a schematic front view of the stitcher 9.

Referring to FIG. 3A, the stitcher 9 comprises a clincher 9*a* arranged under the stitching position X, a stitcher head 9*b* arranged opposite to the clincher 9*a* and movable between an elevated position spaced above the clincher 9*a* and a lowered position close to the clincher 9*a*, and a head elevation mechanism (not shown) moving the stitcher head 9*b* up and down.

The stitcher 9 further comprises a wire reel 9*c*, a wire feed roller pair 9*d* arranged between the wire reel 9*c* and the stitcher head 9*b*, a wire cutter 9*e* arranged between the wire feed roller pair 9*d* and the stitcher head 9*b*, and an interlocking linkage mechanism (not shown) interlocking the wire feed roller pair 9*d* and the wire cutter 9*e* with the vertical movement of the stitcher head 9*b*.

Then the signatures P3 are stopped in sequence at the stitching position X by the intermittent conveying motion of the conveying mechanism 8, and during the stop, the stitcher head 9*b* moves downward from the elevated position to the lowered position and moves upward to the elevated position.

While the stitcher head 9*b* moves downward from the elevated position to the lowered position, a predetermined length of a wire W previously supplied to the stitcher head 9*b* is bent into a U shape and the wire W for stapling the next signature P3 is newly fed into the stitcher head 9*b* by the predetermined length.

When the stitcher head 9*b* reaches the lowered position, the U-shaped wire W is driven into the signature P3 and a portion of the driven wire W protruding downward from the signature P3 is bent by cooperation of the stitcher head 9*b* and the clincher 9*a* whereby the signature P3 is stapled. At the same time, the predetermined length of the wire W newly fed into the stitcher head 9*b* is cut by the wire cutter 9*e*.

Thereafter, the stitcher head 9*b* moves upward from the lowered position to the elevated position while being loaded with the new wire W for stapling the next signature P3.

Further, the wire feed roller pair 9*d* and the wire cutter 9*e* are interlocked with the vertical movement of the stitcher head 9*b* by the interlocking linkage mechanism so that, when a height of the vertical movement of the stitcher head 9*b* is changed (a stroke length of the vertical movement is not changed), correspondingly a length of the wire W fed into the stitcher head 9*b* during downward movement of the stitcher head 9*b* is changed.

The length of the wire W fed into the stitcher head 9*b* is adjusted depending on the thickness of the signature P3 to be stapled.

Figure 3B:
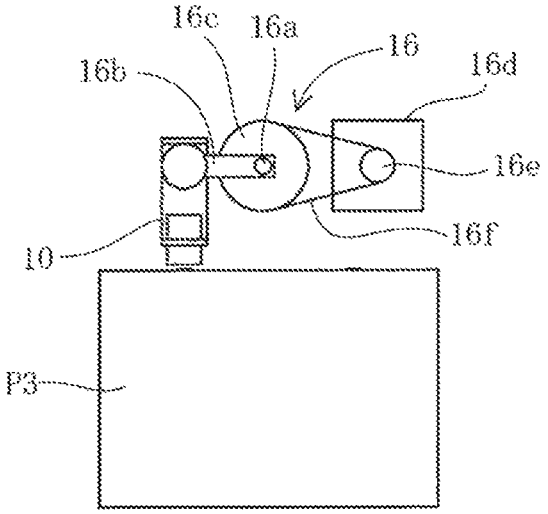
FIG. 3B is a schematic front view of a sensor for detection of a wire and a sensor elevation mechanism of the saddle stitching machine of the saddle-stitch bookbinding system shown in FIG. 1.

FIG. 3B is a schematic front view of the sensor 10 and a sensor elevation mechanism 16.

Referring to FIG. 3B, in this embodiment, the sensor 10 is a proximity sensor. The sensor 10 is arranged above the signature conveying path and guided by a guide (not shown) so as to be movable in a vertical direction. The sensor 10 is moved up and down by the sensor elevation mechanism 16.

The sensor elevation mechanism 16 comprises a horizontal rotation axis 16*a*, a lever 16*b* fixed to the rotation axis 16*a* at one end thereof and pivotally connected to the sensor 10 at the other end thereof, and a pulley 16*c* concentrically mounted on the rotation axis 16*a*. The forward and reverse rotation of the pulley 16*c* causes the lever 16*b* to swing in a vertical plane so that the sensor 10 moves up and down.

The sensor elevation mechanism 16 further comprises a motor 16*d*, a pulley 16*e* mounted on a horizontal drive shaft of the motor 16*d*, and an endless belt 16*f* extending between the pulley 16*e* and the pulley 16*c*.

Thus the forward and reverse rotation of the motor 16*d* causes the lever 16*b* to swing so that a height of the sensor 10 measured from the signature conveying path is changed.

The height of the sensor 10 from the signature conveying path is adjusted depending on the thickness of the signature P4.

The discharging unit 7 is provided with a conveying path 11 extending from the stitching unit 6 to the exit 3*b* of the saddle stitching machine 3 in a direction (indicated by an arrow R4) perpendicular to the signature conveying direction (the arrow R3) of the conveying mechanism 8 of the folding unit 5.

The discharging unit 7 comprises at least one (in this embodiment, one) press roller pair 12 extending across the conveying path 11, and at least one pair (in this embodiment, one pair) of conveyor belt pairs 13, 13 arranged parallel with the conveying path 11 and spaced from each other in a width direction of the conveying path 11, and a center brush 14 arranged above the conveying path 11 and between the pair of conveyor belt pairs 13, 13.

Figure 4A:
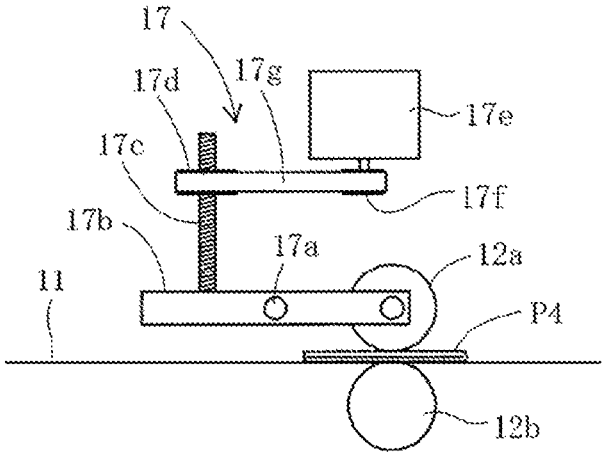
FIG. 4A is a schematic front view of a press roller pair of the saddle stitching machine of the saddle-stitch bookbinding system shown in FIG. 1.
Figure 4B:
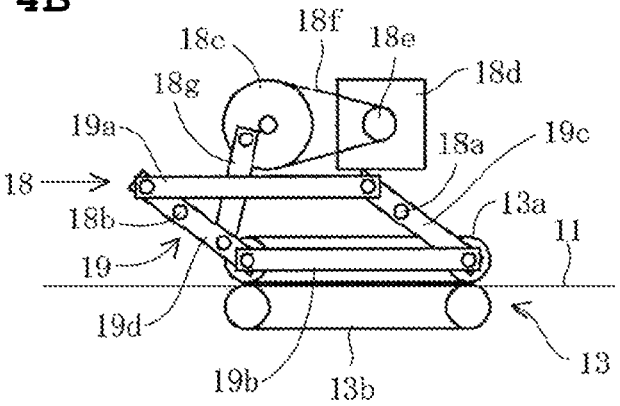
FIG. 4B is a schematic front view of a pair of conveyor belt pairs of the saddle stitching machine of the saddle-stitch bookbinding system shown in FIG. 1.
Figure 4C:
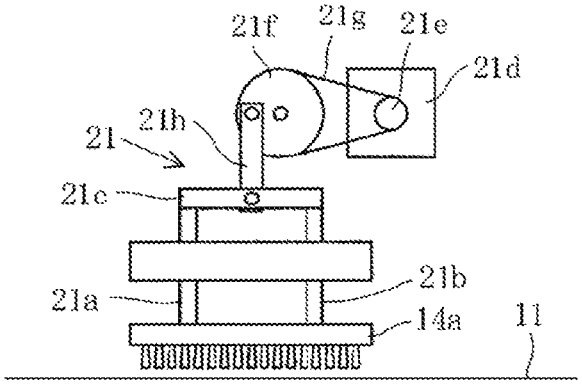
FIG. 4C is a schematic front view of a center brush of the saddle stitching machine of the saddle-stitch bookbinding system shown in FIG. 1.

FIG. 4A is a schematic front view of the press roller pair 12 and FIG. 4B is a schematic front view of the pair of conveyor belt pairs 13, 13 and FIG. 4C is a schematic front view of the center brush 14.

Referring to FIG. 4A, the press roller pair 12 includes a horizontal lower roller 12*b* arranged in place under the conveying path 11 and extending across the conveying path 11, and an upper roller 12*a* extended above and parallel with the lower roller 12*b* and supported by a roller elevation mechanism 17 so as to be movable in a vertical direction.

The roller elevation mechanism 17 includes a pair of levers 17*b* arranged above the conveying path 11 and spaced from each other in a width direction of the conveying path 11. The upper roller 12*a* is supported between one ends of the pair of levers 17*b*.

A screw shaft 17*c* is pivotally connected to the other end of one of the pair of levers 17*b* at a lower end thereof, and a nut 17*d* is arranged in place to rotate in a horizontal plane and screwed into the screw shaft 17*c*.

The roller elevation mechanism 17 further includes a motor 17*e*, a pulley 17*f* mounted on a vertical drive shaft of the motor 17*e*, and an endless belt 17*g* extending between the nut 17*d* and the pulley 17*f*.

Thus the forward and reverse rotation of the nut 17*d* by the motor 17*e* causes the screw shaft 17*c* to move up and down, and the lever 17*b* is rotated about a rotation axis 17*a* by the vertical movement of the screw shaft 17*c*, so that a gap between the press roller pair 12 is changed.

The gap between the press roller pair 12 is adjusted depending on the thickness of the signature P4.

Referring to FIG. 4B, the pair of conveyor belt pairs 13 comprises a pair of lower conveyor belts 13*b* arranged in place under the conveying path 11 and spaced from each other in a width direction of the conveying path 11 and extending parallel with the conveying path 11, and a pair of upper conveyor belts 13*a* arranged above and parallel with the pair of lower conveyor belts 13*b* and supported by a conveyor belt elevation mechanism 18 so as to be movable up and down.

Front rollers of the pair of lower conveyor belts 13*b* are mounted on a common rotation axis while rear rollers of the pair of lower conveyor belts 13*b* are mounted on a common rotation axis. Also, front rollers of the pair of upper conveyor belts 13*a* are mounted on a common rotation axis while rear rollers of the pair of upper conveyor belts 13*a* are mounted on a common rotation axis.

For clarity, frames and drive mechanisms and so on of the upper and lower conveyors 13*a*, 13*b* are omitted in FIG. 4B.

The conveyor belt elevation mechanism 18 comprises a pair of parallel links 19. The parallel link 19 is composed of upper and lower links 19*a*, 19*b* which extend parallel with each other, and front and rear links 19*c*, 19*d* which extend parallel with each other and connect the upper and lower links 19*a*, 19*b*. The pair of parallel links 19 is spaced from each other in the width direction of the conveying path 11 and pivotally connected to horizontal axes 18*a*, 18*b* extending across the conveying path 11 at middle portions of the front and rear links 19*c*, 19*d* thereof.

Further, the rotation axis of the front rollers and the rotation axis of the rear rollers of the pair of upper conveyor belts 13*a* are supported by joint portions of the lower links 19*b* of the pair of the parallel links 19.

The conveyor belt elevation mechanism 18 also comprises a disc crank 18*c* arranged in place above the conveying path 11 so as to be rotatable in a vertical plane, a motor 18*d*, a pulley 18*e* mounted on a horizontal drive shaft of the motor 18*d*, and endless belt 18*f* extending between the disc crank 18*c* and the pulley 18*e*, and a link 18*g* connecting the disc crank 18*c* and a portion of the rear link 19*d* of one of the pair of parallel links 19, the portion being positioned below the rotation axis 18*b*.

Thus the forward and reverse rotation of the disc crank 18*c* by the motor 18*d* causes the front and rear links 19*c*, 19*d* of the pair of parallel links 19 to swing, and thereby the pair of upper conveyor belts 13*a* is moved up and down so that a gap between the respective conveyor belt pairs 13*a*, 13*b*.

The gap between the respective conveyor belt pairs 13*a*, 13*b* is adjusted depending on the thickness of the signature P4.

The center brush 14 comprises a brush 14*a* arranged above the conveying path 11 and a brush elevation mechanism 21 moving the brush 14*a* up and down.

The brush elevation mechanism 21 has guide rods 21*a*, 21*b* arranged to slide in a vertical direction and attached to the brush 14*a* at a lower end thereof, a connection member 21*c* connecting upper ends of the guide rods 21*a*, 21*b*, a disc crank 21*f* arranged in place above the conveying path 11 so as to be rotatable in a vertical plane, a motor 21*d*, a pulley 21*e* mounted on a horizontal drive shaft of the motor 21*d*, an endless belt 21*g* extending between the disc crank 21*f* and the pulley 21*e*, and a link 21*h* connecting the connection member 21*c* and the disc crank 21*f*.

Thus the forward and reverse rotation of the disc crank 21*f* by the motor 21*d* causes the guide rods 21*a*, 21*b* to slide so that the height of the brush 14*a* measured from the conveying path 11 is changed.

The height of the brush 14*a* from the conveying path 11 is adjusted depending on the thickness of the signature P4.

A control unit 15 is operatively connected to the sheet supplying machine 1, the folding machine 2, the saddle stitching machine 3 and the connection unit 4.

Before the start of the operation of the saddle-stich bookbinding system of the present invention, the parameters of the folding machine 2 adjustable depending on the thickness of the sheet P1 (in this embodiment, the gap between the respective roller pairs 22*c*, 22*d*; 22*d*, 22*e* of the buckle-type folding unit and the gap between the pair of folding rollers of the knife-type folding unit 23) are set by the control unit 15 based on the information about the thickness of the sheet P1, and the parameters of the saddle stitching machine 3 adjustable depending on the thickness of the signature P3, P4 (in this embodiment, the length of the wire W fed into the stitcher head 9*b* at every stapling operation of the stitcher 9, the height of the sensor 10, the gap between the press roller pair 12, the gap between the respective conveyor belt pairs 13*a*, 13*b* and the height of the center brush 14 (brush 14*a*)) are set by the control unit 15 based on the information about the thickness of the signature P3, P4 calculated by the control unit 15 using the information about the thickness of the sheet P1 and the information about the folding pattern of the folding machine 2.

Thus the one or more parameters of the folding machine 2 are set based on the information about the thickness of the sheet P1 and the one or more parameters are set based on the information about the thickness of the signature P3, P4 calculated from the information about the thickness of the sheet P1 and the information about the folding pattern of the folding machine 2, and thereby the setting of the parameters of the saddle-stitch bookbinding system can be done easily and quickly.

Also, before the start of the operation of the saddle-stitch bookbinding system, a time elapsed from the start of the sheet feed operation of the sheet supplying machine 1 to the detection of the signature P3 by a sensor 25 is measured by the control unit 15, and, based on the measured value and a processing speed of the saddle stitching machine 3, a value of timing of synchronizing the motion of the saddle stitching machine 3 with a series of motions from the sheet feed motion of the sheet supplying machine 1 to the signature feed motion of the connection unit 4, that is, a value of timing of supplying the next signature P3 from the connection unit 4 to the folding unit 5 when the two-folded signature P3 is fed into the stitching unit 6 of the saddle stitching machine 3 after the completion of folding the signature P3 in the folding unit 5 is calculated by the control unit 15. The calculated value of timing is stored in a memory of the control unit 15.

When the operation of the saddle-stitch bookbinding system is started, the control unit 15 sends a feed operation start command to the sheet supplying machine 1 every time a count value of a rotary encoder 16 corresponds to the timing value stored in the memory. As a result, a continuous operation of the sheet supplying machine 1, the folding machine 2 and the saddle stitching machine 3 is done.

Then the sheets P1 are supplied one by one from a stack of sheets S of the sheet supplying machine 1 to the folding machine 2, folded into the signature P3 by the folding machine 2 and supplied to the entrance 3*a* of the saddle stitching machine 3 from the exit 2*a* of the folding machine 2.

The signature P3 took in the saddle stitching machine 3 is folded in two by the folding unit 5, conveyed to the stitching position X along the signature conveying path by the conveying mechanism 8 of the stitching unit 6 and stapled by the stitcher 9.

The stapled and two-folded signature P4 is conveyed from the stitching position X to a downstream side of the signature conveying path by the conveying mechanism 8. At this time, the stapled and two-folded signature P4 passes under the sensor 10 and the wire W driven into the signature P4 is detected.

The stapled and two-folded signature P4 is delivered from the saddle stitching unit 6 to the discharging unit 7, passed through the gap between the press roller pairs 12, passed through the gap between the respective conveyor belt pairs 13 while being in contact with the center brush 14 (brush 14*a*) at an upper surface thereof and conveyed to the exit 3*b* of the saddle stitching machine 3. Further, the stapled and two-folded signature P4 is conveyed to a three side trimmer 20 arranged downstream of the saddle stitching machine 3, and trimmed by the three side trimmer 20 to finished into a booklet P5.

DESCRIPTION OF REFERENCE NUMERALS

1 Sheet supplying machine
2 Folding machine
2*a* Exit
3 Saddle stitching machine
3*a* Entrance
3*b* Exit
4 Connection unit
5 Folding unit
6 Stitching unit
7 Discharging unit
8 Conveying mechanism
8*a*, 8*c* Upper pulley
8*b*, 8*d* Lower pulley
8*e* Endless belt
8*f* Feed claw
8*g* Motor
9 Stitcher
9*a* Clincher
9*b* Stitcher head
9*c* Wire reel
9*d* Wire feed roller pair
9*e* Wire cutter
10 Sensor
11 Conveying path
12 Press roller pair
12*a* Upper roller
12*b* Lower roller
13 Conveyor belt pair
13*a* Upper conveyor belt
13*b* Lower conveyor belt
14 Center brush
14*a* Brush
15 Control unit
16 Sensor elevation mechanism
16*a* Rotation axis
16*b* Lever
16*c* Pulley
16*d* Motor
16*e* Pulley
16*f* Endless belt
17 Roller elevation mechanism
17*a* Rotation axis
17*b* Lever
17*c* Screw shaft
17*d* Nut
17*e* Motor
17*f* Pulley
17*g* Endless belt
18 Conveyor belt elevation mechanism
18*a*, 18*b* Horizontal axis
18*c* Disc crank
18*d* Motor
18*e* Pulley
18*f* Endless belt
18*g* Link
19 Parallel link
19*a* Upper link
19*b* Lower link
19*c* Front link
19*d* Rear link
20 Three side trimmer
21 Brush elevation mechanism
21*a*, 21*b* Guide rod
21*c* Connection member
21*d* Motor
21*e* Pulley
21*f* Disc crank
21*g* Endless belt
21*h* Link
22 Buckle-type folding unit
22*a* Buckle
22*b* Stopper
22*c*, 22*d* Roller pair
22*d*, 22*e* Roller pair
23 Knife-type folding unit
23*a* Table
23*b* Knife blade
23*c*, 23*d* Folding roller
23*e* Guide rod
23*f* Ball screw
23*g* Pulley
23*h* Pulley
23*j* Motor
23*k* Timing belt
23*m* Nut
24 Sheet conveying unit
25 Sensor
26 Rotary encoder
P1, P2 Sheet
P3, P4 Signature
P5 Booklet
S Stack of sheets
W Wire

The invention claimed is:

1. A saddle-stitch bookbinding system comprising:

a folding machine folding a sheet into a predetermined folding pattern to form a signature;

a saddle stitching machine arranged downstream of the folding machine to staple and fold the signature; and a control unit operatively connected to the folding machine and the saddle stitching machine, wherein the folding machine has one or more parameters adjustable depending on a thickness of the sheet and the saddle stitching machine has one or more parameters adjustable depending on a thickness of the signature, wherein the one or more parameters of the folding machine are set by the control unit based on the information about the thickness of the sheet, and the one or more parameters of the saddle stitching machine are set by the control unit based on the information about the thickness of the signature calculated by the control unit using the information about the thickness of the sheet and the information about the folding pattern of the folding machine, wherein the saddle stitching machine includes:

a stitcher stapling the signature at one or more predetermined positions on a folding line;

a conveying path conveying the stapled signature to an exit; and at least one pair of conveyor belt pairs arranged parallel with the conveying path and spaced from each other in a width direction of the conveying path, and wherein the one or more parameters of the saddle stitching machine include a gap between the respective conveyor belt pairs.

2. The saddle-stitch bookbinding system according to claim 1, wherein the saddle stitching machine further includes:

at least one press roller pair extending across a conveying path, and wherein the one or more parameters of the saddle stitching machine further includes a gap between the at least one press roller pair.

3. A saddle-stitch bookbinding system comprising:

a folding machine folding a sheet into a predetermined folding pattern to form a signature;

a saddle stitching machine arranged downstream of the folding machine to staple and fold the signature; and a control unit operatively connected to the folding machine and the saddle stitching machine, wherein the folding machine has one or more parameters adjustable depending on a thickness of the sheet and the saddle stitching machine has one or more parameters adjustable depending on a thickness of the signature, wherein the one or more parameters of the folding machine are set by the control unit based on the information about the thickness of the sheet, and the one or more parameters of the saddle stitching machine are set by the control unit based on the information about the thickness of the signature calculated by the control unit using the information about the thickness of the sheet and the information about the folding pattern of the folding machine, and wherein the one or more parameters of the saddle stitching machine include a length of a wire stapling the signature at one or more predetermined positions on a folding line.

4. The saddle-stitch bookbinding system according to claim 3, wherein the saddle stitching machine includes a stitcher stapling the signature at one or more predetermined positions on the folding line, and wherein the length of the wire is a length of the wire supplied to the stitcher.

5. The saddle-stitch bookbinding system according to claim 3, wherein the saddle stitching machine includes:

a conveying mechanism conveying the two-folded signature in a saddle manner; and a stitcher arranged at a stitching position on a signature conveying path of the conveying mechanism to staple the two-folded signature at the one or more predetermined positions on the folding line, and wherein the length of the wire is a length of the wire supplied to the stitcher at every stapling operation.

6. The saddle-stitch bookbinding system according to claim 3, wherein the saddle stitching machine includes:

a stitcher stapling the signature at one or more predetermined positions on the folding line; and a sensor detecting the presence of a wire to be driven from the stitcher to the signature, and wherein the one or more parameters of the saddle stitching machine further include a position of the sensor.

7. The saddle-stitch bookbinding system according to claim 3, wherein the saddle stitching machine includes:

a conveying mechanism conveying the two-folded signature in a saddle manner;

a stitcher arranged at a stitching position on a signature conveying path of the conveying mechanism to staple the two-folded signature at the one or more predetermined positions on the folding line; and a sensor detecting the presence of a wire to be driven from the stitcher to the signature, and wherein the one or more parameters of the saddle stitching machine further include a height of the sensor.

* * * * *